United States Patent [19]

Beltrami et al.

[11] 4,218,089

[45] Aug. 19, 1980

[54] FOLDING CHAIR

[76] Inventors: Pier-Angelo Beltrami; Franz Halmdienst, both of 481 8th Ave., New York, N.Y. 10001

[21] Appl. No.: 912,473

[22] Filed: Jun. 5, 1978

[51] Int. Cl.[2] ..... A47C 4/04

[52] U.S. Cl. ..... 297/58; 297/248

[58] Field of Search ..... 297/58, 248, 191

[56] References Cited

U.S. PATENT DOCUMENTS

| | | | |
|---|---|---|---|
| 345,710 | 7/1886 | Mason | 297/191 X |
| 855,872 | 6/1907 | Bedford | 297/58 |
| 1,129,793 | 2/1915 | Craig | 297/58 |
| 1,633,721 | 6/1927 | Young | 297/58 |
| 3,127,218 | 3/1964 | Banke | 297/248 |

FOREIGN PATENT DOCUMENTS

| | | | |
|---|---|---|---|
| 474241 | 8/1969 | Switzerland | 297/248 |

*Primary Examiner*—Francis K. Zugel

*Attorney, Agent, or Firm*—Stephen E. Feldman; Marvin Feldman

[57] ABSTRACT

A three-legged chair having two side legs and a centrally disposed rear support leg wherein, the seat cooperatively moves with respect to the three legs in folding the chair. The third leg folds closed so as to fit between the parallelogram-shaped two side legs, and the folded closed chairs may then be stacked as flush-fitting parallelograms. The sides of the side legs are formed with complementary connecting parts so that the folded open chairs may be attached so as form a row or pew.

13 Claims, 5 Drawing Figures

FOLDING CHAIR

FIELD OF THE INVENTION

This invention relates to folding chairs.

BACKGROUND OF THE INVENTION

Heretofore folding chairs were constructed where the seat would fold between the rear legs, and the weight on the folded open seat having to be taken up by the seat to rear leg connections. The opposed, spaced rear legs were thus both movably connected to other parts of the chair which resulted in a weak and rickety construction, particularly so with long continued use. Furthermore the presence of the folding rear legs at the sides of the chair provided a location at which snagging or pinching could occur to a person using the chair. When folded, the prior art folding chairs often had protruding leg and seat portions which were cumbersome to stack. Also many prior art folding chairs when folded open were difficult to arrange and maintain in uniform rows.

Now there is provided by the present inventon a folding chair which provides a sturdy leg construction and yet is readily folded to a compact form.

It is therefore a principal object of this invention to provide a folding chair which is of sturdy leg construction and yet economically utilizes space in both the open position and the folded closed position.

It is another object of this invention to provide a folding chair construction which avoids the problems present in the conventional four-legged folding chairs.

It is another object of this invention to provide a folding chair which is readily folded to compact form and which then can be stacked in an even controlled manner.

It is still a further object of this invention to provide a folding chair which when opened may be readily assembled in a row so as to form a pew, and may likewise be disassembled.

It is still a further object of this invention to form a sturdy construction with good weight support.

It is still a further object of this invention to provide a folding chair which is readily manufactured of conventional building materials and yet is safe and practical in use.

The aforesaid as well as other objects and advantages will become apparent from a reading of the following specification, the adjoined claims, and the accompanying drawings in which;

DESCRIPTION OF THE PREFERRED EMBODIMENT

Figure 1:
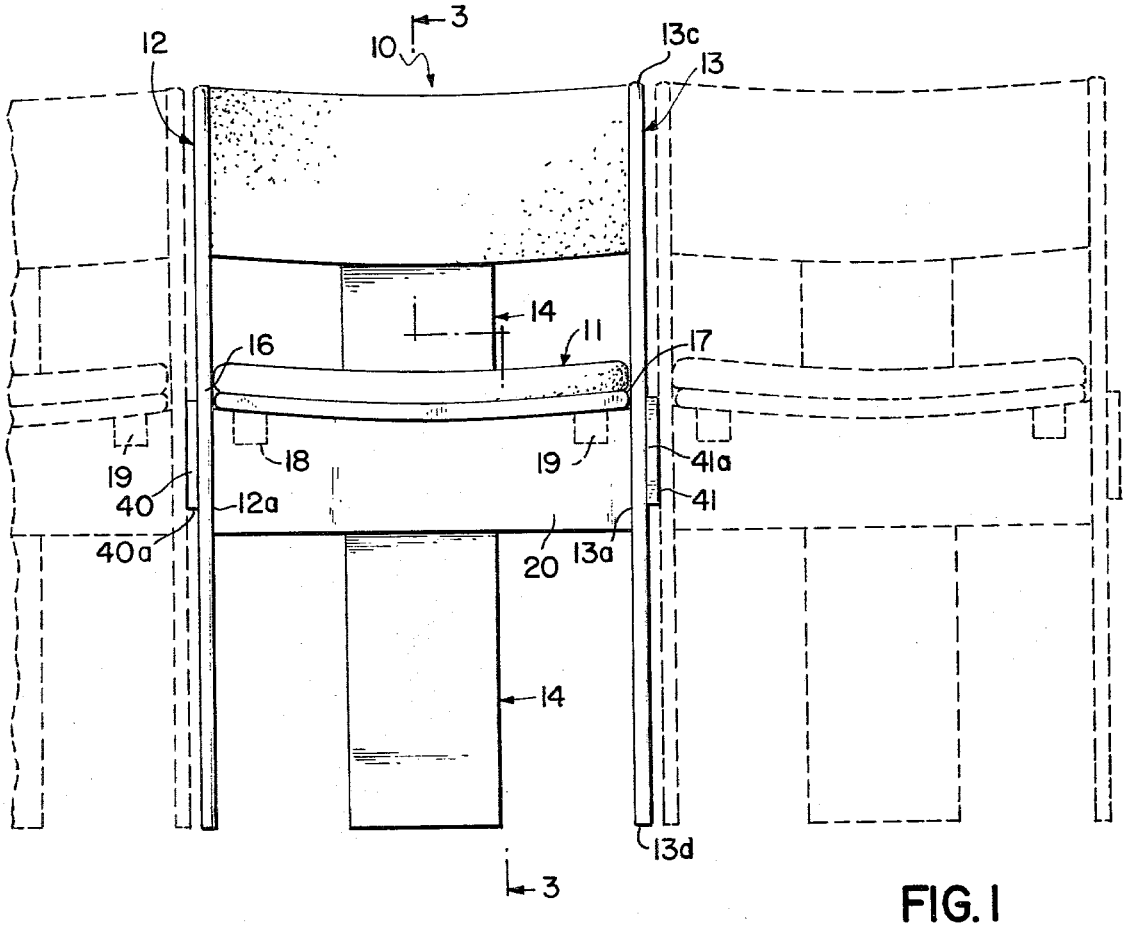
FIG. 1 is a front elevational view of the folding chair, in the folded open position, with other attached folding chairs in broken line construction showing the resultant row or pew.
Figure 2:
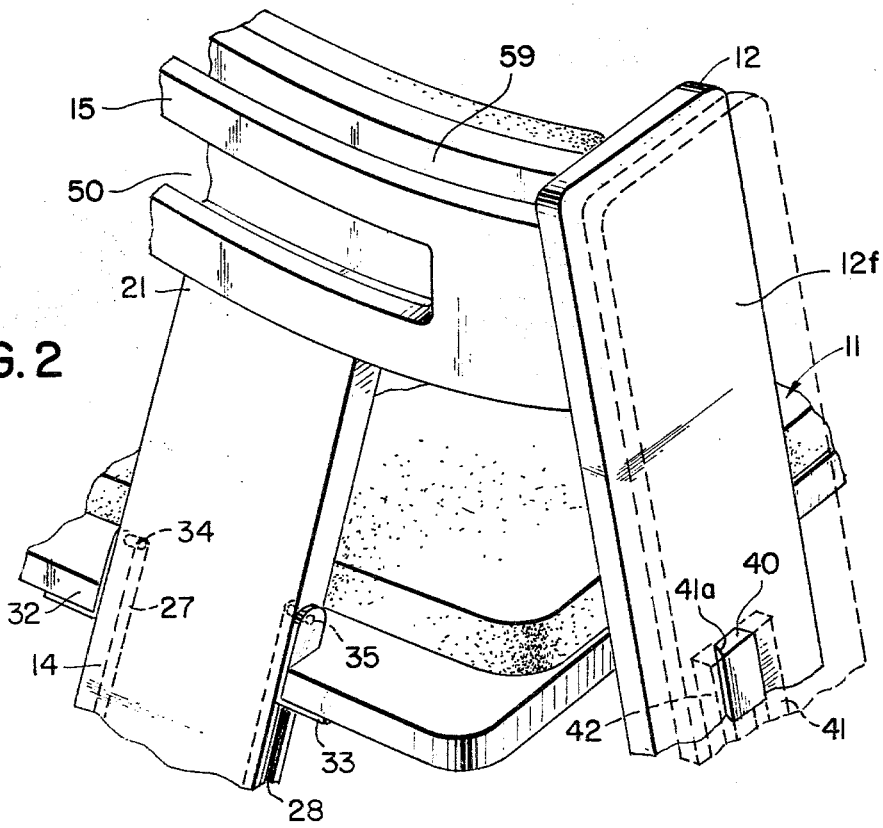
FIG. 2 is a right rear perspective with a parital fragmentary view.

Referring to FIGS. 1-4 there is shown the folding chair of this present invention which is generally referenced by numeral 10. Chair 10 comprises a seat 11, flanked by two side legs 12 and 13, and a centrally disposed rear leg 14, and a back 15 to which the legs 12, 13 and 14 are connected. Leg 12 is designated the right side leg and leg 13 is designated the left side leg.

Seat 11 is pivotally connected to legs 12 and 13 by metal pins 16 and 17 respectively, and seat 11 is also hinged at 18 and 19 to cross-brace support member 20, which member 20 is also fixedly attached to the respective inner sides **12*a* and 13*a* of side legs 12 and 13. Back 15 is also fixedly secured to the inner leg sides 12*a* and 13*a***.

Rear leg 14 is centrally disposed between the side legs 12 and 13, and covers approximately one-third of the middle between said side legs. The top end 21 of leg 14 is pivotally hinged by hinges at 22 and 23 to the bottom 24 of back 15, and the bottom 26 of leg 14 rests on the floor. Leg 14 is also formed with two oppositely disposed parallel grooves 27 and 28 formed in the sides 24 and 30 of rear leg 14. The rear portion of seat 11 is formed with a cut-out 31 to receive leg 14, and is also provided with two metal brackets 32 and 33 having inwardly disposed opposing metal pins 34 and 35 which pins are slidably disposed in respective grooves 27 and 28. Leg 14 is also formed with a transversly disposed lip 36 which abuts the top 37 of seat 11, and such abuttment occurs to prevent pins 34 and 35 from contacting the top ends of grooves 27 and 28.

Figure 3A:
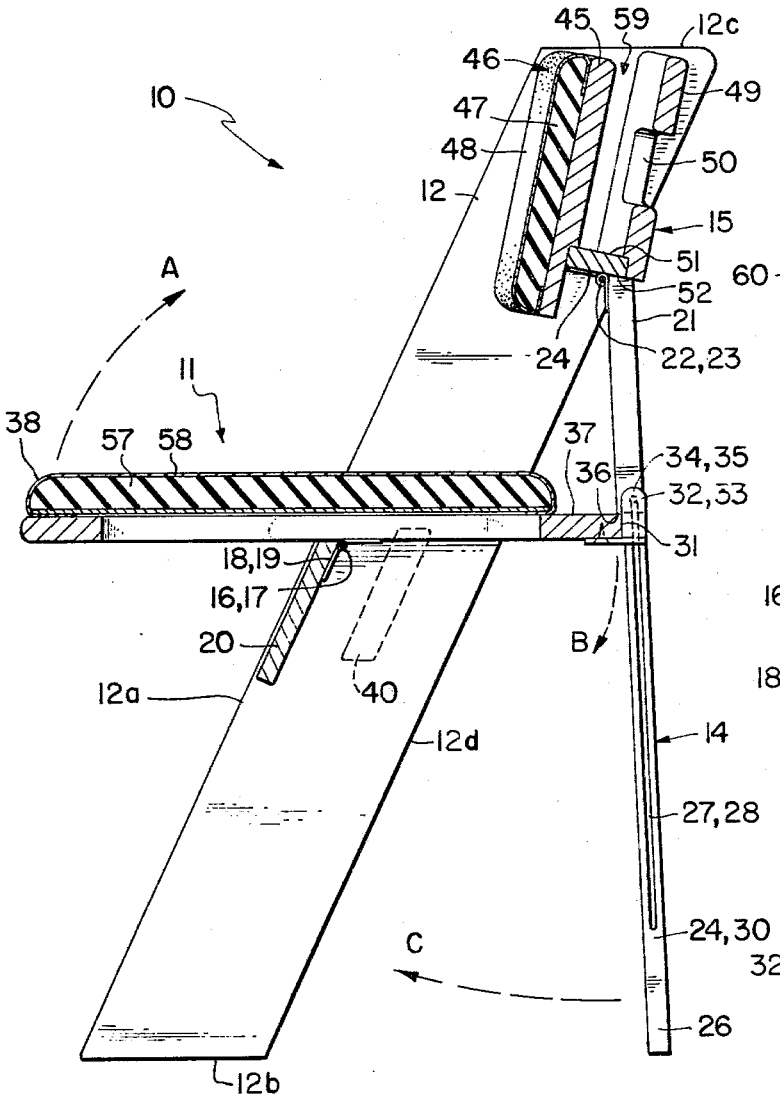
FIG. 3A is a sectional view taken along line 3—3 of FIG. 1, with broken line showing an intermediate folding position.
Figure 3B:
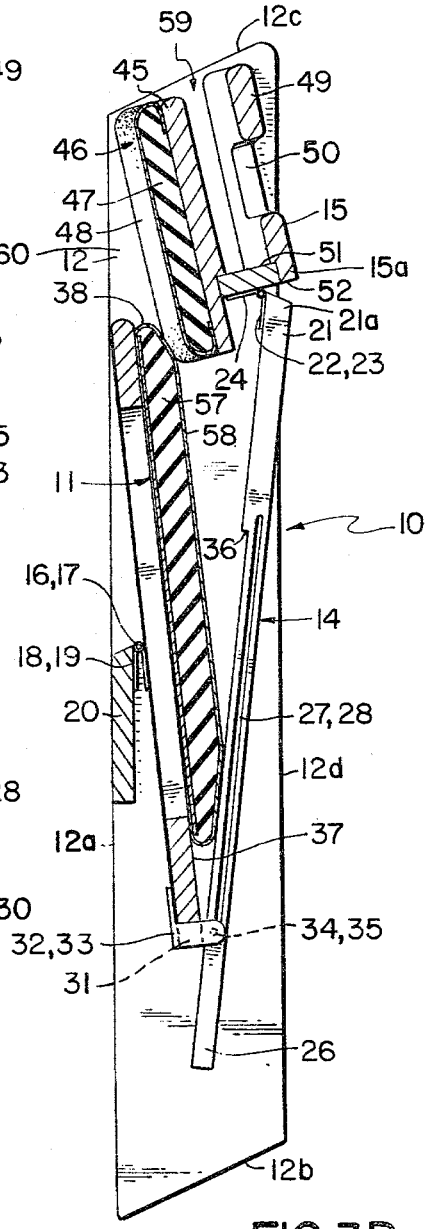
FIG. 3B is a sectional view taken along line 3—3 of FIG. 1. but showing the chair in the folded closed position.

In this manner of construction as best shown in FIGS. 3A-3B, the folding operation to close the chair occurs by lifting the front end 38 of seat 11 and rotating the seat as shown by arrow A, the seat being rotated about pins 16 and 17 and hinges 18 and 19. Seat 11 further slides downwardly in grooves 27 and 28 as shown by arrow B, which through resulting action rear leg 14 rotates about hinges 22 and 23 so as to move to a position between side legs 12 and 13, (arrow C).

Figure 4:
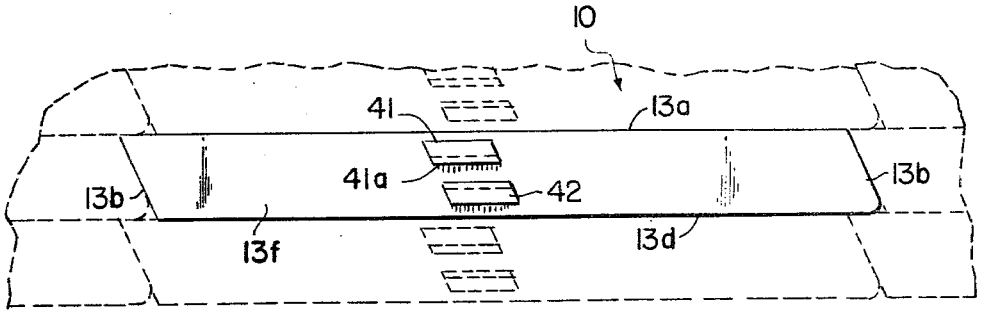
FIG. 4 is a left side elevational view of the chair of FIG. 1 as shown in the horizontal stacked position with other such stacked chairs in broken line view.

Each side leg is shaped to corresponding parallelograms, wherein the bottom edge **12*b* (13*b*), the side edges 12*c*, 12*d* (13*c*, 13*d*) and the top edge 12*e* (13*e***) form the respective parallelograms. In the folded closed position the seat, and rear legs, as well as the back, fit within the sides of the parallelograms. In this manner, as best shown in FIG. 4, the folded chairs may be conviently stacked in an even, controlled manner utilizing the space in an economical manner.

In a further aspect of this invention the outwardly disposed sides **12*f* and 13*f* of side legs 12 and 13 respectively are formed with outwardly protruding blocks 40 and 41, 42 respectively. Blocks 40, 41 and 42 are sized and undercut around the blocks 40*a*, 41*a* and 42*a*, respectively; so that block 40 slides between blocks 41 and 42** so that adjacent side legs of adjacent chairs may be detachably flush-mounted to form a row or pew as best shown in FIG. 1.

Back 15 is formed with a foreward disposed curved member 45 to which is mounted a foamed 47 and cloth-covered 48 backrest 46; and a rearwardly disposed curved member 49 formed with a cut-out 50 for carrying purposes. Members 45 and 49 are fixedly secured to joining member 51, and 45, 49 and 51 are fixedly secured to inner leg sides **12*a* and 13*a*. Joining member 51 supports hinges 22 and 23 and in the folded open position, the top 21 of leg 14 abuts the underside 52 of joining member 51 so as to form a T-shaped leg 14 and back 15** construction. Thus the T-shaped readily supports the weight on the back portion of the seat.

Also in the folded open position the weight of the seat 11 is taken up by the cross brace 20 as well as by the rear leg lip 36 so as to evenly distribute the weight.

Seat 11 is formed with a foam padded 57 and cloth covered 58 seat in the conventional manner of construction and attachment.

Referring specifically to FIG. 3B, chair 10 is shown in the fully closed position. In the closed position, seat 11, rear leg 14, and back 15 fit within and are protected within the perimeter defined by the parallelograms **12*b*–12*e* (13*b*–13*e*). It is to be noted that in FIG. 3B small portions 15*a* and 21*a* of 15 and 21 extend somewhat outwardly from edges 12*d*, 13*d*, but substantially the entire leg 14 and seat 11 is within parallelograms 12*b*–12*e* (13*b*–13*e*), and in stacking (as shown in FIG. 4) the outwardly extending portions of 15 and 21 fit within the recess 60 joined between backrest 46 and edges 12*a* and 13*a*. It is also noted that in the closed position, pins 34 and 35 reside at the bottom end portions of their respective grooves 27 and 28**, which bottom end portion of the grooves serve as stop members.

It another aspect, rearwardly disposed member 49, joining member 51 and forwardly disposed backrest member 45, form a well 59, which serves to hold books, such as song or prayer books, particularly so when the chairs form several pews. Thus persons in one pew may utilize the wells of the pew immediately in front.

It is also within the contemplation of this invention that the side legs form geometric shapes, other than parallelograms, which may permit similar stacking, such as trapezoids and other similar polygons.

Thus there is provided by the present invention a padded comfortable seat, which is of sturdy construction and evenly distributes the weight while readily folded closed to a compact evenly stackable form, and when unfolded may be arranged and maintained in even rows. And when the chairs are arranged in rows, the rows conviently form pews.

Obviously, many modifications and variations of the invention, as hereinabove set forth, can be made without departing from the spirit and scope thereof, and therefore only such limitations should be imposed as are indicated in the appended claims.

What is claimed is:

1. A folding chair comprising:

a seat;

two side legs being disposed on opposite sides of said seat, and means to pivot said seat to said side legs;

a back, said back being connected to said side legs and being formed with a rearward extension;

one rear leg; said rear leg being centrally disposed to said seat and back and being spacedly disposed from said side legs;

means to slidably connect said seat and rear leg comprising a pair of parallel disposed grooves formed in said rear leg and a pair of pins fixedly mounted to said seat and slidably moving in the respective grooves;

said side legs being dimensioned so that said seat and rear leg fold within the forward and rearward extent of said side legs;

and means to pivotally connect said rear leg to said back extension, whereby in the folded open position said rear leg extends downwardly from said extension and outwardly from said side legs, and in the folded closed position said seat pivots with respect to said side legs and slides within said rear leg, and said rear leg pivots on said back extension to fold inwardly so that said seat and rear leg oppositely pivot and infold to reside within said forward and rearward extent of said side legs.

2. The folding chair of claim 1, each of said side legs being formed with means to detachably attach other of said folding chairs so as to form a row of chairs.

3. The folding chair of claim 2, the adjacent legs of the attached chairs in each row being flush.

4. The folding chair of claim 1, said grooves being formed in opposing side edges of said leg, and said pins being in opposed spaced relationship.

5. The folding chair of claim 4, and stop means comprising a lip formed in said rear leg and said lip being transversely disposed across said rear leg, and wherein said seat abuts said lip in the folded open position.

6. The folding chair of claim 1, the respective top and bottom ends of each of said side legs forming opposing sides of a parallelogram.

7. The folding chair of claim 3, said chair attaching means comprising means to slidably connect the chairs.

8. The folding chair of claim 7, said attaching means comprises complementary members formed on the side legs, said members being formed with grooves for slidably connecting the chairs.

9. The folding chair of claim 1, said rear leg and back forming a T-shaped portion, and backrest means formed on said T-shaped portion.

10. The folding chair of claim 9, further comprising a slot formed in said back for carrying said chair, and wherein the slot is rearwardly disposed from said backrest means.

11. The folding chair of claim 1, said back being formed with a well for receiving books.

12. The folding chair of claim 1, further comprising a cross-brace member and said means to pivotally connect said seat being connected to said cross-brace member, whereby said seat pivots in relation to said cross-breace member in folding.

13. The folding chair of claim 1, wherein said cross-brace member is fixedly attached at its ends to said side legs, and wherein the weight on the chair is supported by said cross-brace to which it is connected.

* * * * *